United States Patent [19]

Aoyama

[11] 4,397,270

[45] Aug. 9, 1983

[54] VALVE OPERATING MECHANISM FOR INTERNAL COMBUSTION ENGINES

[75] Inventor: Shunichi Aoyama, Yokohama, Japan

[73] Assignee: Nissan Motor Co., Ltd., Yokohama, Japan

[21] Appl. No.: 138,792

[22] Filed: Apr. 8, 1980

[30] Foreign Application Priority Data

Apr. 13, 1979 [JP] Japan ..... 54-45195

[51] Int. Cl.[3] ..... F01L 1/18

[52] U.S. Cl. ..... 123/90.16; 123/90.39

[58] Field of Search ..... 123/90.12, 90.13, 90.15, 123/90.16, 90.17, 90.39, 90.41, 90.6, 90.45

[56] References Cited

U.S. PATENT DOCUMENTS

| | | | |
|---|---|---|---|
| 1,950,590 | 3/1934 | Berry | 123/90.45 |
| 2,097,883 | 11/1937 | Johansson | 123/90.16 |
| 2,806,459 | 9/1957 | Sweat | 123/90.16 |
| 2,880,711 | 4/1959 | Roan | 123/90.16 |
| 2,880,712 | 4/1959 | Roan | 123/90.16 |
| 3,413,965 | 12/1968 | Gavasso | 123/90.16 |
| 4,174,683 | 11/1979 | Vivian | 123/90.39 |
| 4,192,263 | 3/1980 | Kitagawa et al. | 123/90.39 |

FOREIGN PATENT DOCUMENTS

| | | | |
|---|---|---|---|
| 167887 | 6/1954 | Australia . | |
| 202734 | 11/1955 | Australia . | |
| 209542 | 11/1956 | Australia . | |
| 348023 | 2/1922 | Fed. Rep. of Germany . | |
| 2629554 | 1/1978 | Fed. Rep. of Germany . | |
| 493221 | 4/1919 | France . | |
| 2226556 | 11/1974 | France . | |
| 2357731 | 2/1978 | France . | |
| 110224 | 5/1925 | Switzerland | 123/90.16 |

*Primary Examiner*—Craig R. Feinberg
*Assistant Examiner*—W. R. Wolfe
*Attorney, Agent, or Firm*—Thompson, Birch, Gauthier & Samuels

[57] ABSTRACT

A valve operating mechanism of an internal combustion engine including a first cam rotatable about an axis in timed relation to the engine speed, a second cam rockable about an axis and operatively engaged with a valve of the engine, a rocker arm rockable about an axis and interposed between said first and second cams to provide operative connection therebetween, and means responsive to varations of engine condition for shifting the axis of rocking movement of said rocker arm relative to said axes of said first and second cams thereby varying the angular position of said second cam independently of that of said first cam whereby valve lift, valve timing and the period during which the valve is open are varied in accordance with the varying operating conditions of the engine.

2 Claims, 13 Drawing Figures

VALVE OPERATING MECHANISM FOR INTERNAL COMBUSTION ENGINES

BACKGROUND OF THE INVENTION

This invention relates to a valve operating mechanism for internal combustion engines and more particularly to an apparatus for varying the valve lift and timing in accordance with the varying operating conditions of the engine.

The customary internal combustion engine utilizes a valve operating mechanism constructed to control the opening and closing of the intake and exhaust valves at timings which are fixed for all operating conditions of the engine in a manner to meet the requirement of the high-speed operating conditions of the engine. Such a valve operating mechanism, however, causes incomplete combustion of the mixture during idling and at low engine speeds due to excessively large valve overlap at such engine speeds, resulting in high pollution levels from the engine, marked deterioration of fuel economy and a loss in engine performance efficiency during idling and at low engine speeds.

With a view to eliminating these problems in such a valve operating mechanism, various valve operating mechanisms have heretofore been proposed which are operative to vary valve lift and timing, but difficulties are still encountered in such variable valve operating mechanisms' being put to practical use due to their relatively complex and bulky construction and due to the difficulty in controlling the valve timing strictly in accordance with the varying operating conditions of the engine. For example, a variable valve timing camshaft is known which has a relatively good practical usefulness but has difficulty in controlling the valve timing strictly in accordance with the varying operating conditions of the engine. Furthermore, the customary variable valve timing camshaft cannot vary the valve lift profile and the valve opening period. The present invention is directed to elimination of all these problems inherent in the prior art valve operating mechanisms of the type providing variable valve timing as well as of the type providing constant valve lift and timing.

SUMMARY OF THE INVENTION

It is, therefore, an important object of the present invention to provide a valve operating mechanism which is operative to vary valve lift and timing in accordance with the varying operating conditions of an internal combustion engine and which has a simple and economical construction and is readily controlled in strict relation to the varying operating conditions of the engine.

It is a further object of the present invention to provide a valve operating mechanism of the above mentioned character which is operative to vary the period during which the valve is open.

It is a further object of the present invention to provide a valve operating mechanism of the above mentioned character which has an excellent practical usefulness.

It is a still further object of the present invention to provide a valve operating mechanism of the above mentioned character which is capable of varying the valve overlap in such a manner as to meet the varying requirements of the operating conditions of the engine, resulting in the highest possible performance and efficiency of the engine over all of the operating conditions of the engine.

It is a still further object of the present invention to provide a valve operating mechanism of the above mentioned character which is well suited for overhead camshaft engines.

In accordance with the present invention, such objects are accomplished basically in by providing an apparatus which comprises a first cam rotatable about an axis in timed relation to the engine speed, a second cam rockable about an axis and operatively engaged with a valve of the engine, a rocker arm rockable about an axis and interposed between said first and second cams to provide an operative connection therebetween, and means for shifting the axis of rocking movement of said rocker arm relative to said axes of said first and second cams thereby varying the angular position of said second cam independently of that of said first cam in response to variation of engine operating condition.

BRIEF DESCRIPTION OF THE DRAWINGS

The features and advantages of the valve operating mechanism according to the present invention will become more apparent from the following description taken in conjunction with the accompanying drawings, in which.

DESCRIPTION OF THE PEFERRED EMBODIMENT

Figure 1:
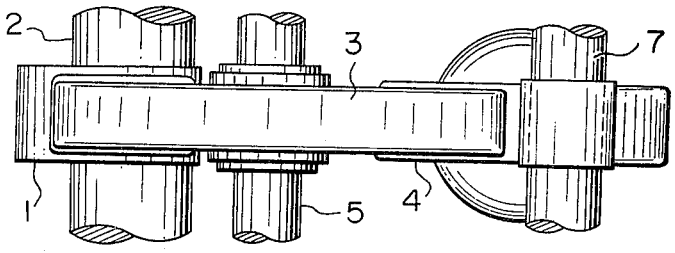
FIG. 1 is a top plan view of a preferred embodiment of the valve operating mechanism according to the present invention.
Figure 2:
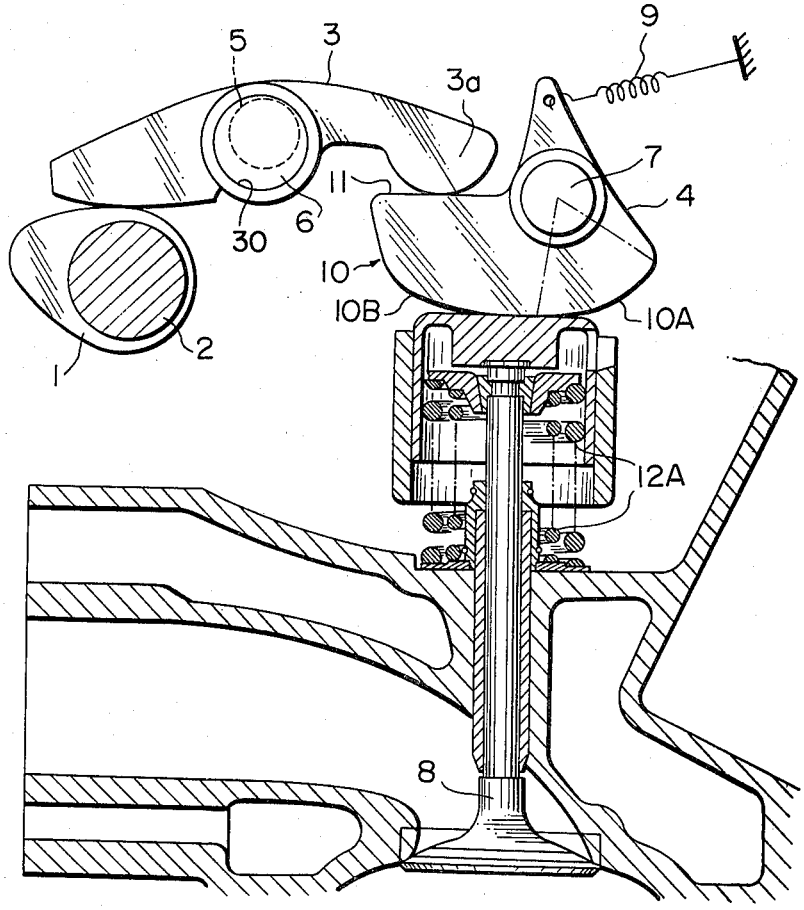
FIG. 2 is a view partly in side elevation and partly in section showing the valve operating mechanism of FIG. 1 for controlling a valve mounted in the cylinder head of an internal combustion engine.
Figure 3:
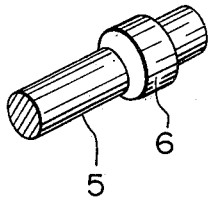
FIG. 3 is a perspective view showing a rocker shaft utilized in the valve operating mechanism of FIGS. 1 and 2.

Referring to FIGS. 1 and 2, there is shown a first cam 1 which is integrally secured to a camshaft 2 and is rotatable with the camshaft 2 in timed relation to the rotation of an engine crankshaft (not shown), i.e., the engine speed. As an alternative to the first cam 1 having the contour depicted in the drawing, an eccentric cam or a circular disc eccentrically attached to a camshaft may be utilized. The first cam 1 is operatively engaged with a rocker arm 3 which in turn is operatively engaged with a second or rocking motion cam 4. The rocker arm 3 has a hollow cylindrical internal sleeve 30 which forms a bearing surface for the rocking motion of rocker arm 3. A rocker shaft 5 is shown in FIG. 3 and has an eccentric bearing 6 integrally secured thereto. Bearing 6 is cylindrical in shape, but has an axis which is offset from and parallel to the axis of rocker shaft 5. As can be seen in FIGS. 1 and 2, rocker shaft 5 extends through internal sleeve 30 of rocker arm 3 and the rocker arm internal sleeve 30 rocks on the peripheral surface of bearing 6. The axes of internal sleeve 30 and rocker shaft 5 are always offset and parallel. This arrangement independently of the angular position of the first cam 1 thereby varying the valve lift and timing as will be hereafter described.

The second cam 4 is rockably supported on a camshaft 7 and is operatively engaged with a poppet valve 8 mounted in the cylinder head (no numeral) of the engine. The first cam 1 rotates to cause rocker arm 3 to rock which causes second cam 4 to rotate which causes valve 8 to open and close.

The second cam 4 receives from the rocker arm 3 a driving force which tends to rotate the second cam in the counterclockwise direction in FIG. 2 while at the same time the second cam receives from a spring 9 a biasing force which tends to rotate the second cam 4 in the clockwise direction in FIG. 2. In FIG. 1, the spring 9 is omitted for the reason of simple and clear illustration. The second cam 4 is provided with a valve-engaging cam surface portion 10. The point of contact on cam surface portion 10 at which the second cam 4 and the valve 8 are engaged with each other is displaced along the cam surface portion 10 in response to variations in the balancing conditions of the above two forces.

The valve-engaging cam surface portion 10 of the second cam 4 consists of a dwell cam surface portion or a concentric circular arc portion 10A which cannot impart a lifting movement to the valve 8 and a rise and return cam surface portion or a valve lifting cam surface portion 10B which can impart a lifting movement to the valve 8. The contour of the rise and return cam surface portion 10B is designed such that the valve lift increases with the increasing rotation of the second cam in a predetermined direction, i.e., in the counterclockwise direction in FIG. 2. The second cam 4 is further provided with a rocker arm-engaging surface portion 11 on the side opposite to the valve-engaging cam surface portion 10, with which surface portion 11 one end 3*a* of the rocker arm 3 is operatively engaged.

With such a contour of the valve-engaging cam surface portion 10, when the rocker arm 3 is displaced upwardly and in a parallel manner from the position illustrated in FIG. 2 through rotation of the rocker shaft 5, the second cam 4 is caused to rotate under the bias of the spring 9 in the clockwise direction to the extent permitted by the clearance which is created between the end 3*a* of the rocker arm 3 and the rocker arm-engaging surface portion 11. This results in variation in the timed relation between the second cam 4 and the valve 8, i.e., an increase of the effective angular range of the dwell cam surface portion 10A of the second cam 4, and consequently the smaller valve lift and the shorter period during which the valve 8 is open.

Figure 4:
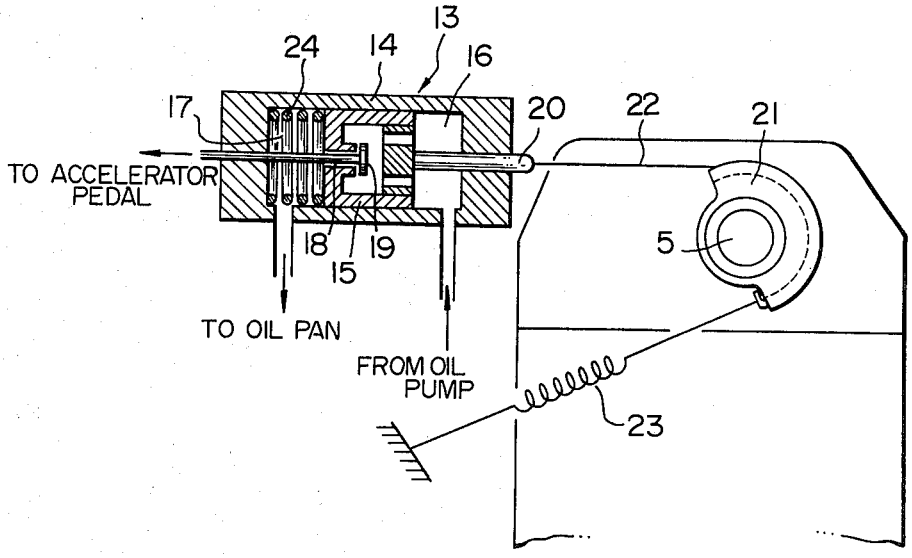
FIG. 4 is a view partly in section and partly in side elevation showing a hydraulic control device utilized in the valve operating mechanism of FIGS. 1 and 2.

The position of the axis of rocking movement of the rocker arm 3 is controlled by a control means such as, for example, a hydraulic control device or actuator 13 shown in FIG. 4, which is operatively coupled with the rocker shaft 5.

Referring to FIG. 4, the hydraulic control device 13 comprises a cylinder 14 and a piston 15 slidably received within the cylinder 14. High and low oil pressure chambers 16 and 17 are located at the respective ends of the piston 15 which is formed with an orifice or oil passage 18 providing communication between the high and low oil pressure chambers 16 and 17. The high oil pressure chamber 16 is fluidly connected to the oil pump (not shown) of the engine which provides lubrication oil to the engine, and the low oil pressure chamber 17 is fluidly connected to the oil pan (not shown) of the engine. A valve 19 is disposed in the oil passage 18 and is operative to open and close the passage 18 thereby providing and obstructing communication between the high and low oil pressure chambers in response to movement of the accelerator pedal or the engine output control member (not shown). The piston 15 is provided with a piston rod 20, and the rocker shaft 5 has a flange 21. The piston rod 20 and the flange 21 are operatively coupled to each other by a wire 22. A spring 23 urges the flange 21 and therefore the rocker shaft 5 in the clockwise direction in the drawing. Within the low oil pressure chamber 17 is disposed a compression spring 24 which urges the piston 15 in a right-hand direction in the drawing.

With the arrangement thus described of the control device 13, as the accelerator pedal is increasingly depressed, the valve 19 moves increasingly in the left-hand direction in the drawing to close the oil passage 18. Upon closure of the oil passage, the piston 15 moves, compressing the spring 24, in the left-hand direction due to the oil pressure prevailing in the high oil pressure chamber 16, the oil pressure being supplied thereto from the pump that provides lubricating oil to the engine. In response to this movement of the piston 15, the rocker shaft 5 rotates in the counterclockwise direction in the drawing against the bias of the spring 23.

If the accelerator pedal is then maintained continuously at a certain depressed position and consequently the valve 19 stops moving, the piston 15 stops moving since the amount of oil pressure required to further drive the piston 15 in the left-hand direction in the drawing is released from the high oil pressure chamber 16 to the low oil pessure chamber 17 through the oil passage 18 so as to balance the piston driving forces of the spring 24 and the pressurized oil in the high oil pressure chamber 16.

From the above, it will be understood that the control device 13 is operative to control the angular position of the rocker shaft 5 so that the position varies in proportion to the amount of depression on the accelerator pedal and therefore to the degree of opening of the throttle valve of the engine.

Referring to FIGS. 5A to 5C and 6A to 6E, the operation of the valve operating mechanism of this invention will now be described. In the Figures, there are omitted some parts such as the spring 9 connected to the second cam 4 for the reason of ensuring simple and clear illustration.

Figure 5A:
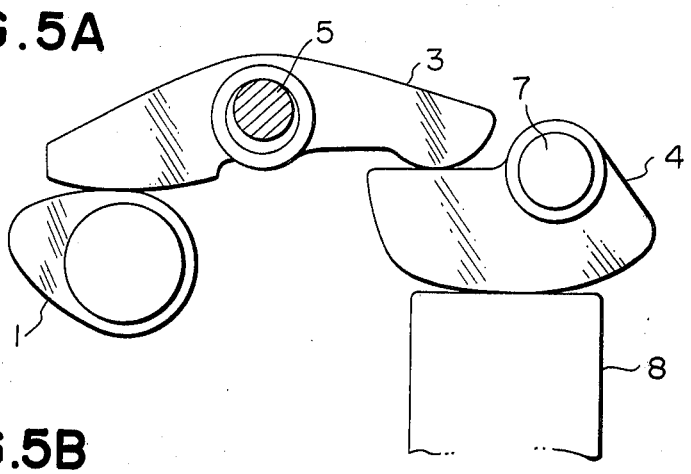
FIGS. 5A to 5C are views partly in side elevation and partly in section showing sequential positions of the valve operating mechanism of FIGS. 1 and 2 with some parts omitted, in which positions the axis of rocking movement of the rocker arm has been shifted to its lowest possible position.
Figure 5B:
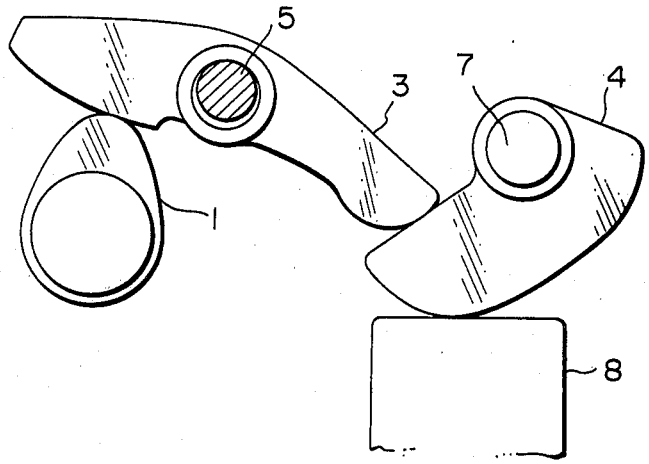
Figure 5C:
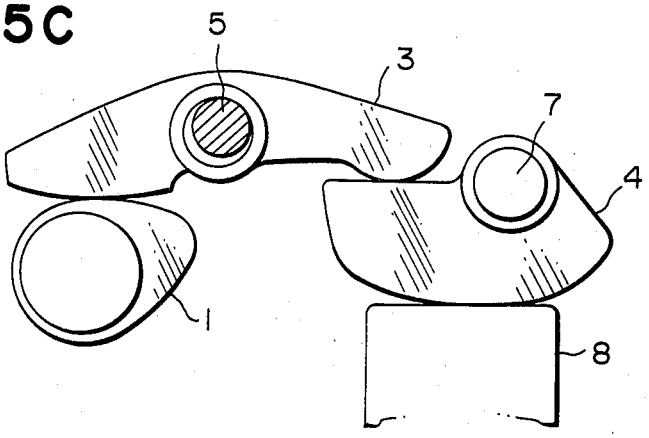

FIGS. 5A to 5C show the operating positions of the valve operation mechanism in which the axis of rocking movement of the rocker arm 3 is maintained at its lowest possible position and in which the valve lift becomes largest.

More particularly, shown in FIG. 5A is the operating position in which the second cam 4 is in the state of being about to be driven by the first cam 1, i.e., the state just before the first cam 1 further rotates in a clockwise direction and begins to lift the left end of rocker arm 3 and begins to cause the rocker arm to rock in a clockwise direction. This is also the state in which the valve-engaging point on the cam surface portion 10 of second cam 4 is located on the dwell cam surface portion 10A. In this position, valve 8 is fully seated and closed. As soon as first cam 1 begins to rock the rocker arm 3, second cam 4 rotates in a counter-clockwise direction to reposition the valve-engaging point on the cam surface portion 10 to a location on valve lifting surface portion 10B which causes valve 8 to begin to progressively lift and open.

Shown in FIG. 5B is the operating position of the valve operating mechanism in which the rocker arm 3 has been rotated by first cam 1 to substantially the maximum clockwise position possible for the rocker arm to assume. In this position, the rocker arm 3 imparts a nearly maximum rocking movement to the second cam 4 and the valve lift becomes nearly maximum.

After the operating position of FIG. 5B, the valve operating mechanism will more to the position shown in FIG. 5C through further rotation of the first cam 1 in the clockwise direction. During the rotational movement of the first cam 1 from the position of FIG. 5B to that of FIG. 5C, the second cam 4 rotates in the clockwise direction in response to the dual biasing forces of the spring 9 and the valve spring 12. Such rotation of the second cam 4 results in a gradual decrease of the valve lift. When the second cam 4 assumes the position of FIG. 5C, the valve 8 regains the seated and closed condition.

During further clockwise rotational movement of the first cam 1 from the position of FIG. 5C to that of FIG. 5A, its dwell cam surface portion is kept engaged with the rocker arm 3. As a result, no rocking movement of the rocker arm 3 occurs during this time, and therefore the valve 8 remains closed.

Figure 7:
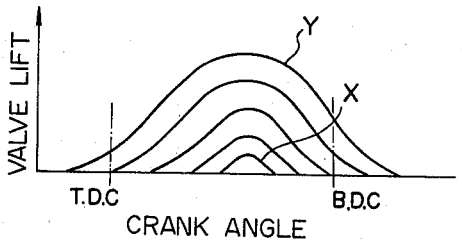
FIG. 7 is a graph showing an example of the performance characteristics of the valve controlled by the valve operating mechanism according to the present invention.

FIG. 7 shows an example of the performance characteristics of the valve 8 operated by the valve operating mechanism according to this invention, the valve being assumed to be an intake valve of an internal combustion engine in this example. The curve X corresponds to the low speed and light load engine operation, and the curve Y corresponds to the high speed and heavy load engine operation. As will be seen from this graph, the valve lift changes along a relatively gentle curve in the vicinity of the maximum lift since the rocking movement speed at such time becomes minimum.

Referring next to FIGS. 6A to 6E, there are shown the operating positions of the valve operating mechanism in which the rocker shaft 5 has been rotated 180° relative to the angular position of the rocker shaft shown in FIGS. 5A to 5C so that the axis of rocking movement of the rocker arm 3 is located at its highest possible position causing the valve lift to become smallest.

In these operating positions, since the rocker arm 3 is maintained at a relatively higher position with respect to that of FIGS. 5A to 5C, the second cam 4 assumes a relatively clockwise advanced position since the upward movement of the axis of rocking movement of the rocker arm 3 allows the second cam 4 to rotate in the clockwise direction under the bias of the spring 9 until the cam surface portion 11 of the second cam 4 engages with the end 3*a* of the rocker arm 3. As a result, the effective angular range of the dwell cam surface portion 10A becomes larger. That is, even in the operating position of FIG. 6A in which the rise and return cam surface portion of the first cam 1 is imparting a rocking movement ot the rocker arm 3 which in turn is imparting a rocking movement to the second cam 4, the second cam 4, which is still in the state of engaging with the valve 8 at its dwell cam surface portion 10A, does not impart a lifting movement to the valve 8. In other words, when the axis of rocking movement of the rocker arm 3 assumes a higher position, the second cam 4 carries out a lost motion for a longer period during which the second cam rotates without imparting a lifting movement to the valve 8.

Figure 6A:
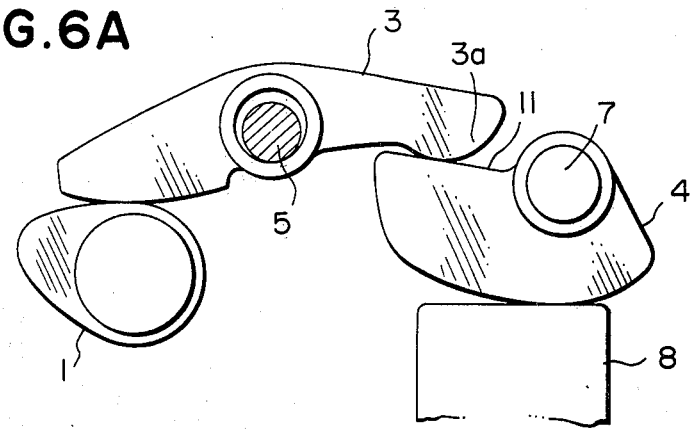
FIGS. 6A to 6E are views similar to FIGS. 5A to 5C but illustrating the sequential positions in which the axis of rocking movement of the rocker arm has been shifted to its highest possible position.
Figure 6B:
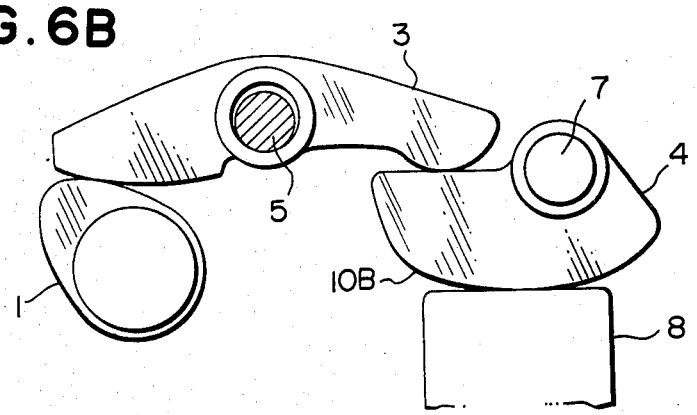

When, however, the second cam 4 assumes the angular position of FIG. 6B in which the rise and return cam surface porton 10B begins to engage with the valve 8, the second cam 4 begins to impart a lifting movement to the valve 8. The valve lift becomes maximum when the valve operating mechanism is put into the position shown in FIG. 6C.

Figure 6C:
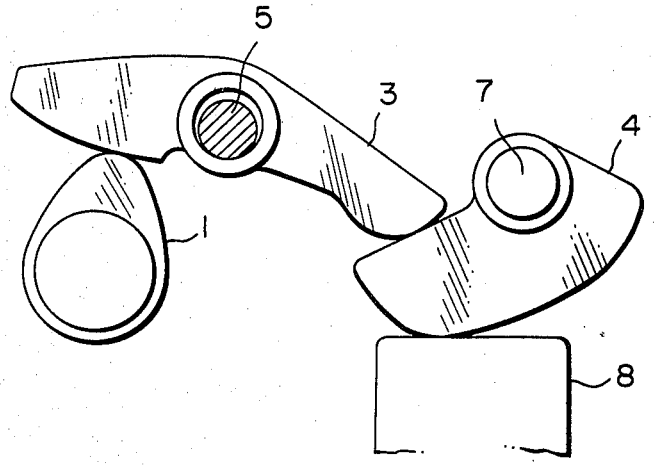

In this instance, it will be understood that the amount of maximum valve lift obtained in the case of FIG. 6C is substantially reduced as compared to that in the case of FIG. 5B and that the amount of maximum valve lift changes with the variation of the initial phase or angular position of the second cam 4, the initial angular position being intended to indicate the angular position into which the second cam 4 is put when the first cam 1 engages its dwell cam surface portion with the left end of the rocker arm 3.

Figure 6D:
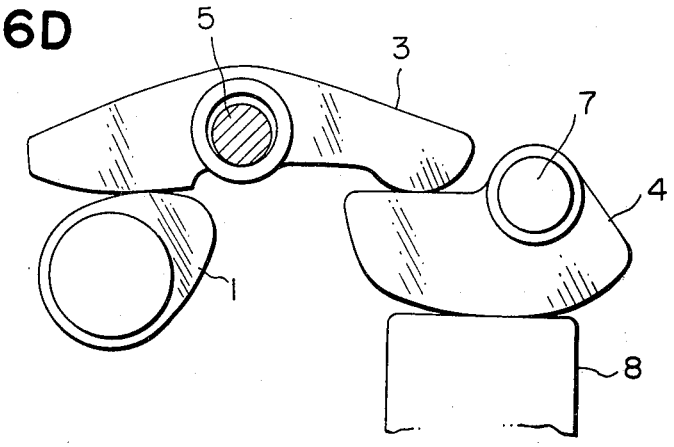
Figure 6E:
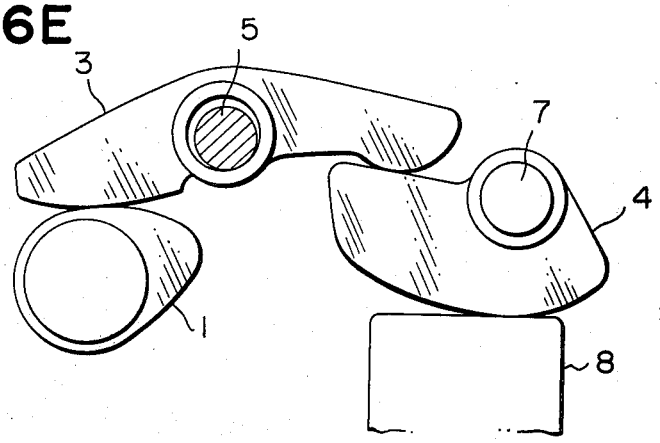

After the operating position of FIG. 6C, the valve operating mechanism moves into the operating position of FIG. 6D and then into FIG. 6E in which the first cam 1 engages its dwell cam surface portion with the rocker arm 3 thereby permitting the valve 8 close. In this instance, it will be understood that the period during which the valve 8 is open is shorter as compared with that in the case of FIGS. 5A to 5C.

By selectively changing the position of the axis of rocking movement of the rocker arm 3 through rotation of the rocker shaft 5, the valve operating mechanism of this invention can variably control the valve lift, the valve opening and closing timing and the valve opening period as shown in FIG. 7.

From the above, it will be understood that in the case where the valve operating mechanism according to this invention is applied to operate an intake valve of an internal combustion engine the throttle valve of the engine can be eliminated since a valve operating mechanism having such performance characteristics as shown in FIG. 7 is capable of controlling the induction of the engine without employing the throttle valve thereby preventing the so-called "pumping loss" resulting from the throttle valve in a part throttle operating condition.

It will be further understood that the valve operating mechanism according to this invention can be utilized to operate an exhaust valve of an internal combustion engine as well as an intake valve.

By the foregoing, there has been provided a valve operating mechanism calculated to fulfill the objects set forth, and while only one preferred embodiment has been illustrated and described in detail, various additions, substitutions, modifications and omissions may be made thereto without departing from the spirit of the invention as encompassed by the appended claims.

What is claimed is:

1. A valve operating mechanism for the valves of an internal combustion engine comprising:

(a) a first cam rotatable about an axis in timed relation to the engine speed;

(b) a second cam rockable about an axis and operatively engaged with a valve of the engine;

(c) a rocker arm rockable about an axis and interposed between said first and second cams to provide an operative connection therebetween;

(d) control means for sensing variations of engine operating condition; and (e) means responsive to said control means for shifting the axis of rocking movement of said rocker arm relative to the axes of said first and second cams thereby varying the angular position of said second cam relative to the angular position of said first cam;

(f) said shifting means including a rocker arm internal cylindrical sleeve, a rocker shaft extending through said sleeve, and an eccentric bearing secured to said rocker shaft and mounted for rocking motion within said rocker arm sleeve, said eccentric bearing having an axis spaced from and parallel to the axis of said rocker shaft causing the axis of rocking motion of said rocker arm to be non-coaxial with the axis of rocking motion of said rocker shaft;

(g) said control means including a cylinder, a piston slidable in said cylinder, said piston forming and separating a high oil pressure chamber at one end of said cylinder and a low oil pressure chamber at the other end of said cylinder, said high oil pressure chamber being fluidly connected to the engine oil pump, said low oil pressure chamber being fluidly connected to the engine oil pan, said piston being normally urged by high oil pressure towards said low oil pressure chamber, said piston having an oil passage formed therein providing communication between said high and low oil pressure chambers, a valve disposed in said oil passage and movable towards said high oil pressure chamber to open said passage, and movable towards said low oil pressure chamber to close said passage, said valve being movably actuated by said control means in response to sensed varying engine operating conditions, a spring disposed in said low oil pressure chamber, said spring urging said piston towards said high oil pressure chamber to permit said valve to close said oil passage, and connecting means linking said piston and said rocker shaft for rotating said rocker shaft in response to movement of said piston.

2. A valve operating mechanism for the valves of an internal combustion engine as claimed in claim 1, wherein said connecting means includes a flange fixed to said rocker shaft, a wire interconnecting said flange and said piston, and a spring operatively connected to said flange, said spring urging said rocker shaft to rotate in the direction opposite to the direction in which said piston pulls on said wire.

* * * * *